US006615693B1

(12) United States Patent
Liao

(10) Patent No.: US 6,615,693 B1
(45) Date of Patent: Sep. 9, 2003

(54) RATCHET TOOL WITHOUT DRILLING HOLES IN AN INSIDE OF THE TOOL HEAD

(76) Inventor: I-Ho Liao, 11F-2, No. 43, Chai-I Street, Taichung (TW)

( * ) Notice: Subject to any disclaimer, the term of this patent is extended or adjusted under 35 U.S.C. 154(b) by 0 days.

(21) Appl. No.: 10/163,291

(22) Filed: Jun. 6, 2002

(51) Int. Cl.[7] ..... B25B 13/46
(52) U.S. Cl. ..... 81/60; 81/61; 192/43.1
(58) Field of Search ..... 81/60–63.2, 58; 192/43.1

(56) References Cited

U.S. PATENT DOCUMENTS 2,407,558 A * 9/1946 Kress ..... 192/43.1
2,744,432 A * 5/1956 Rueb ..... 81/62
2,982,161 A * 5/1961 Angquist et al. ..... 81/62
3,044,591 A * 7/1962 Kilness ..... 192/43.1
4,574,928 A * 3/1986 Norton ..... 192/43.1
6,357,323 B2 * 3/2002 Chi et al. ..... 81/60
6,530,296 B1 * 3/2003 Liao ..... 81/60

* cited by examiner

*Primary Examiner*—D. S. Meislin
(74) *Attorney, Agent, or Firm*—Charles E. Baxley

(57) ABSTRACT

A ratchet tool includes a head with a hole and a driving member is rotatably received in the hole. A plurality of teeth are defined in an inside of the hole and a plurality of notches are defined in an outer periphery of the driving member. Each notch has a pawl received therein which is engaged with the teeth. A spring ring is mounted to the pawls and positions and pushes the pawls in the notches.

4 Claims, 4 Drawing Sheets

RATCHET TOOL WITHOUT DRILLING HOLES IN AN INSIDE OF THE TOOL HEAD

FIELD OF THE INVENTION

The present invention relates to a ratchet tool that has a driving member rotatably received in the tool head and several pawls received in notches in the outside of the driving member so as to be engaged with the teeth in an inside of the tool head.

BACKGROUND OF THE INVENTION

A conventional ratchet tool generally includes a tool head and a hole is defined through the too head so that a driving member is rotatably received in the hole of the tool head. A recess is defined in an inside of the hole in the tool head so as to receive a pawl therein and the pawl is engaged with the teeth defined in an outside of the driving member. The pawl is biased by a spring so that when rotating the tool in one direction, the pawl is securely engaged with the driving member so as to tighten or loosen an object. On the other hand, when rotating the tool in the other direction, the pawl moves over the teeth of the driving member and the driving member is remained still. Although this arrangement is used for a long period of time, it requires a special tool and drill to make the recess in the inside of the hole of the tool head and the special tool and drill make the manufacturing of the ratchet tool become high.

The present invention intends to provide a ratchet tool that does not need to drill the recess in the inside of the hole of the tool head.

SUMMARY OF THE INVENTION

In accordance with one aspect of the present invention, there is provided a ratchet tool which comprises a tool head having a hole defined therethrough and teeth are defined in an inside of the hole. A driving member is rotatably received in the hole and has a plurality of are notches defined in an outer periphery of the driving member. Each notch comprises a short surface, a long surface and an arcuate surface which is connected between the short surface and the long surface.

Each notch has a pawl received therein which is an elongate member having engaging teeth defined in a first end thereof and a rounded convex extending from a second end of the pawl. The engaging teeth are engaged with the teeth in the inside of the hole. A short side and a long side are respectively connected to two sides of the rounded convex. The rounded convex is engaged with the arcuate surface of the notch corresponding thereto. The short side faces the short surface and the long side faces the long surface. A protrusion extends from one of a top and a bottom of each of the pawl.

A spring ring is mounted to the protrusions of each of the pawls and pushes the pawls toward the driving member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
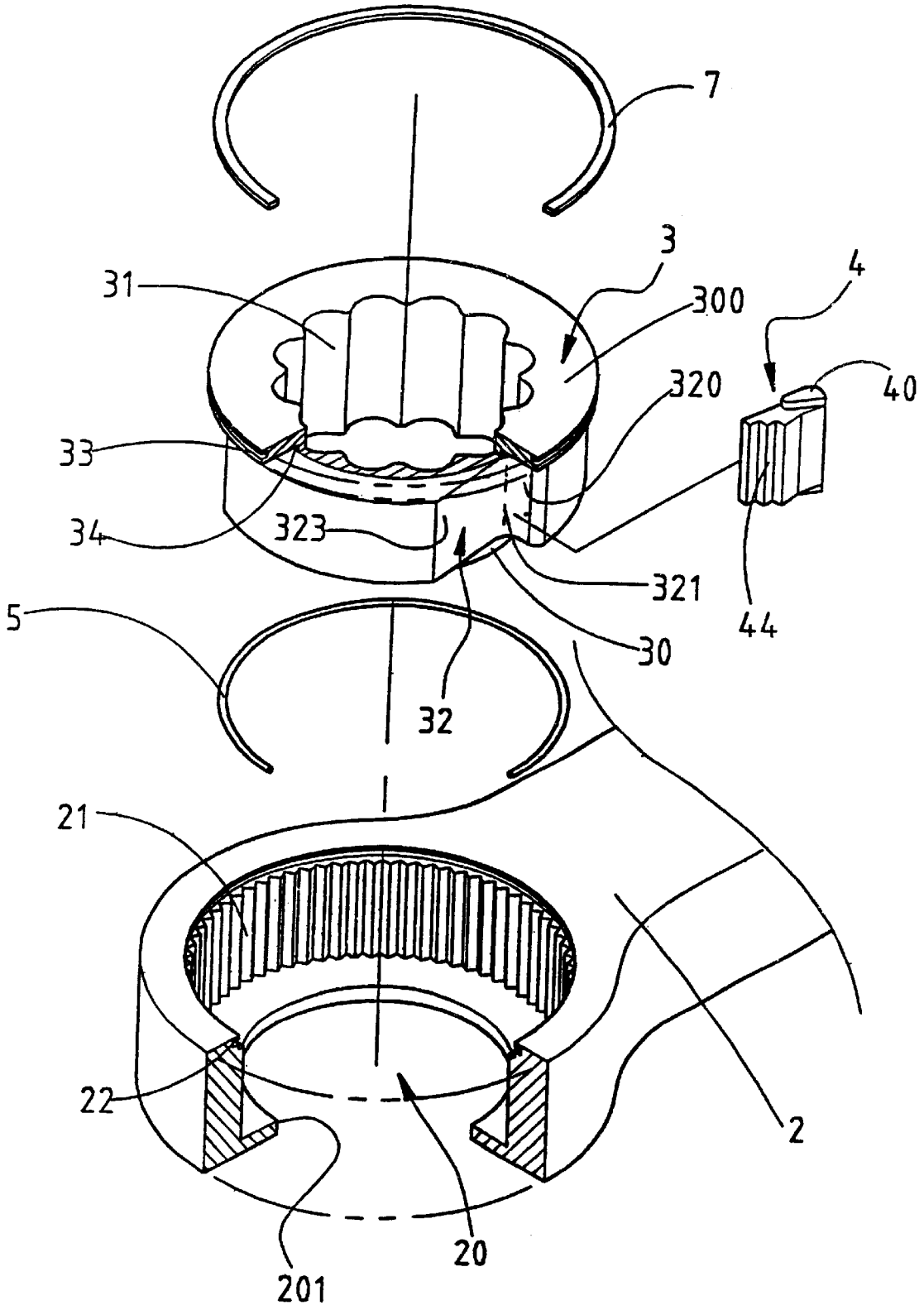
FIG. 1 is an exploded view to show the ratchet tool of the present invention.
Figure 2:
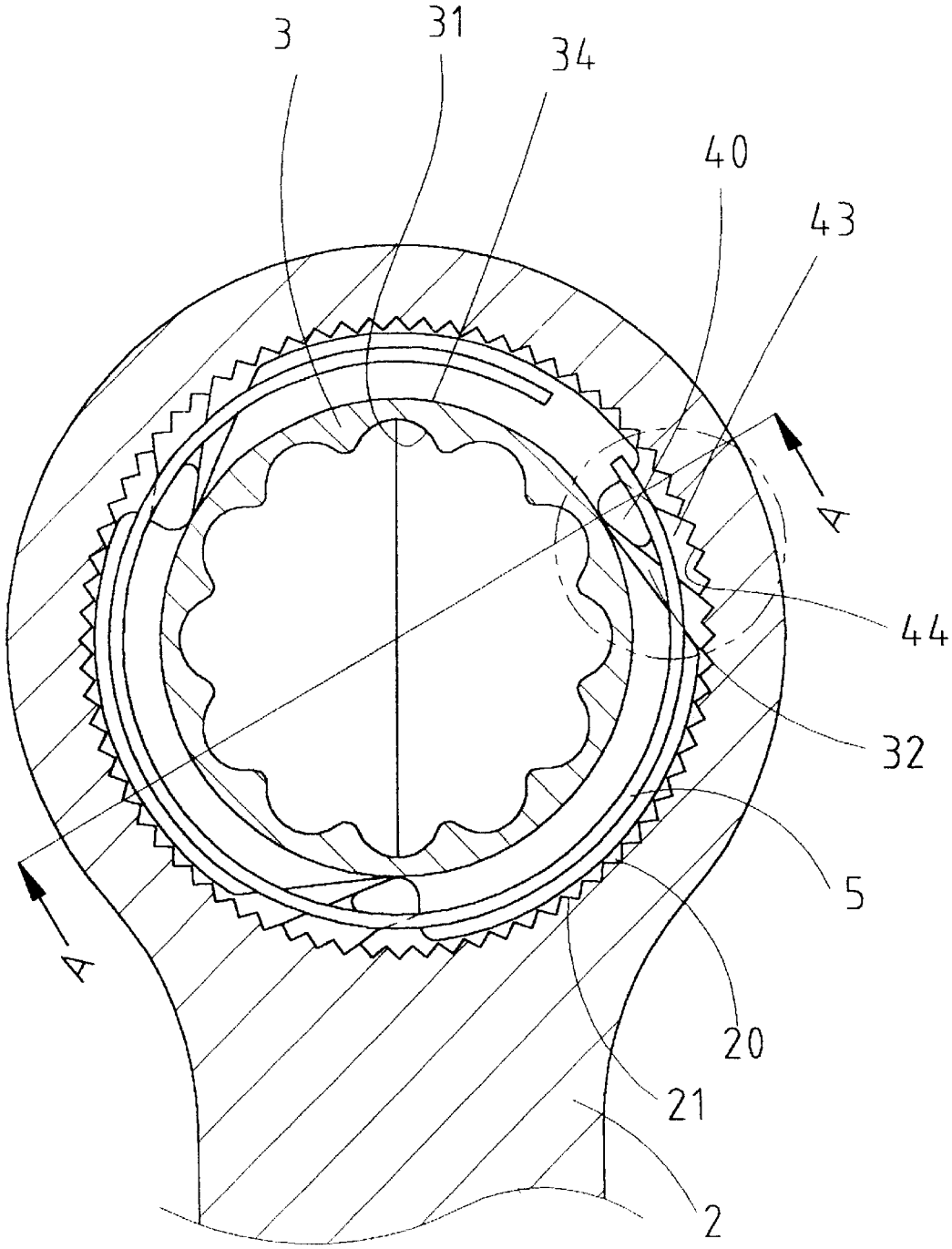
FIG. 2 is a plan view to show the ratchet tool of the present invention.

Referring to FIGS. 1, 2, 3 and 5, the ratchet tool of the present invention comprises a tool head 2 having a hole 20 defined therethrough and teeth 21 are defined in an inside of the hole 20. An aperture 201 defined by an inward flange extending from a bottom of the tool head 2, and a groove 22 is defined in the inside of the hole 20 near the top of the tool head 2. A driving member 3 is rotatably received in the hole 20 and has an engaged hole 31 defined therethrough which is engaged with an object to be tightened or loosened. A convex portion 30 extends from an end of the driving member 3 and is engaged with the aperture defined in a center of the flange 201. A flange 300 extends outward from the other end of the driving member 3 and a groove 33 is defined in an outer periphery of the flange 300. A retaining ring 7 is engaged in the groove 33 and the groove 22 to retain the driving member 3 in the hole 20 of the tool head 2.

A plurality of notches 32 are defined in an outer periphery of the driving member 3 and each notch 32 comprises a short surface 320, a long surface 323 and an arcuate surface 321 which is connected between the short surface 320 and the long surface 323. An annular groove 34 located below the flange 300 is defined in the outer periphery of the driving member 3 and communicates with the notches 32.

Each notch 32 has a pawl 4 received therein which is an elongate member having engaging teeth 44 defined in a first end thereof and a rounded convex 42 extends from a second end of the pawl 4. A protrusion 40 extends from one of a top and a bottom of each of the pawl 4. The protrusion 40 has an engaging surface 400 defined in a vertical wall thereof and the engaging surface 400 faces the teeth 21 in the inside of the hole 20 of the tool head 2. A spring ring 5 is engaged with the annular groove 34 and mounted to the protrusions 40 of each of the pawls 4 and pushes the pawls 4 toward the driving member 3.

The engaging teeth 44 are engaged with the teeth 21 in the inside of the hole 20. A short side 41 and a long side 43 are respectively connected to two sides of the rounded convex 42 which is engaged with the arcuate surface 231 of the notch 32 corresponding thereto. The short side 41 faces the short surface 320 and the long side 43 faces the long surface 323.

A minimum distance between the rounded convex 42 and the engaging teeth 44 is longer than a minimum distance between the arcuate surface 321 of each of the notches 32 to the teeth 21 defined in an inside of the hole 20.

Figure 4:
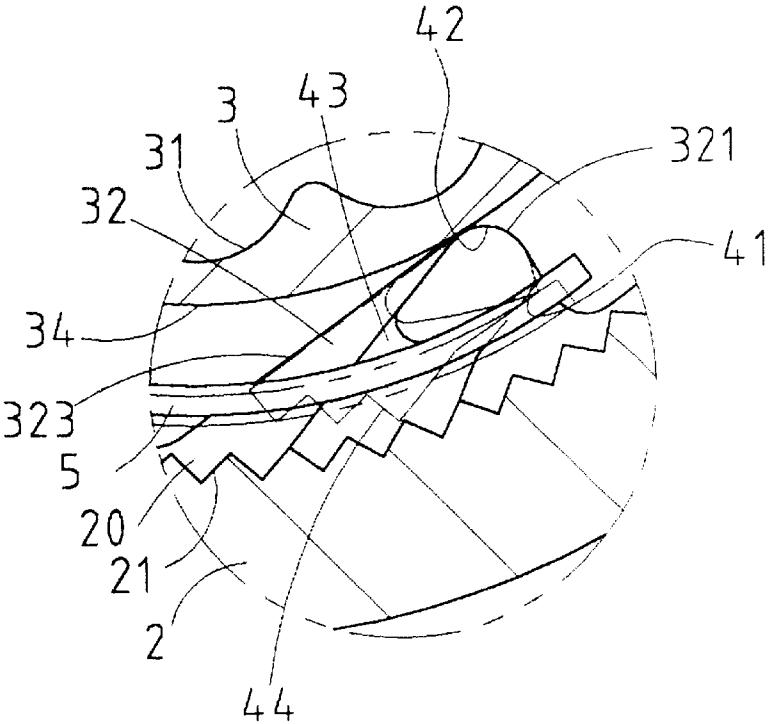
FIG. 4 shows the pawl is pushed away from the teeth in the inside of the hole of the tool head when the tool is rotated in clockwise.
Figure 3:
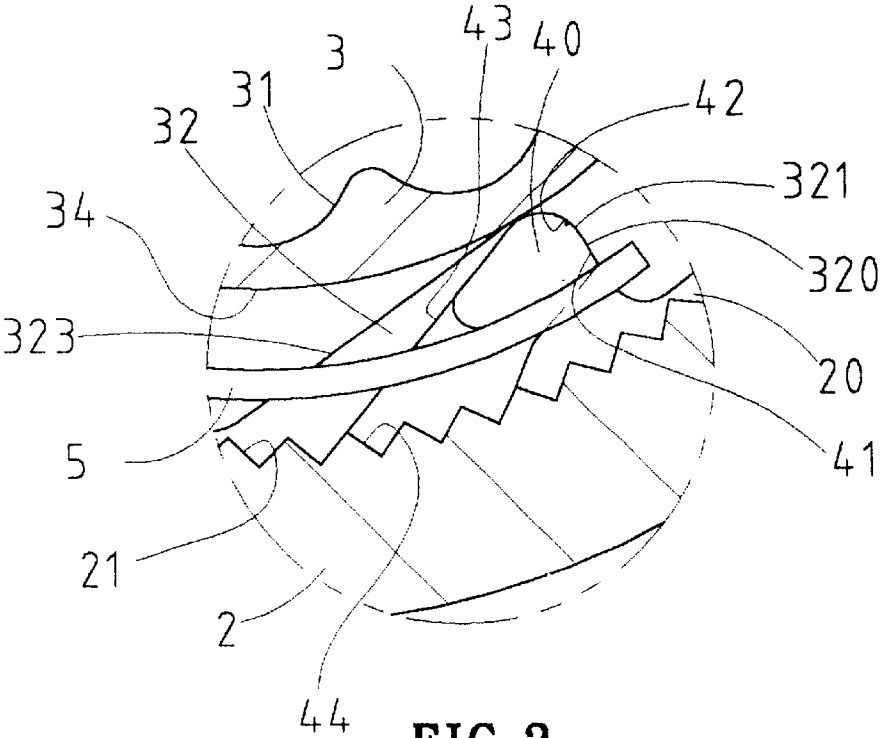
FIG. 3 shows the pawl securely engaged with the teeth in the inside of the hole of the tool head when the tool is rotated in counter clockwise.
Figure 5:
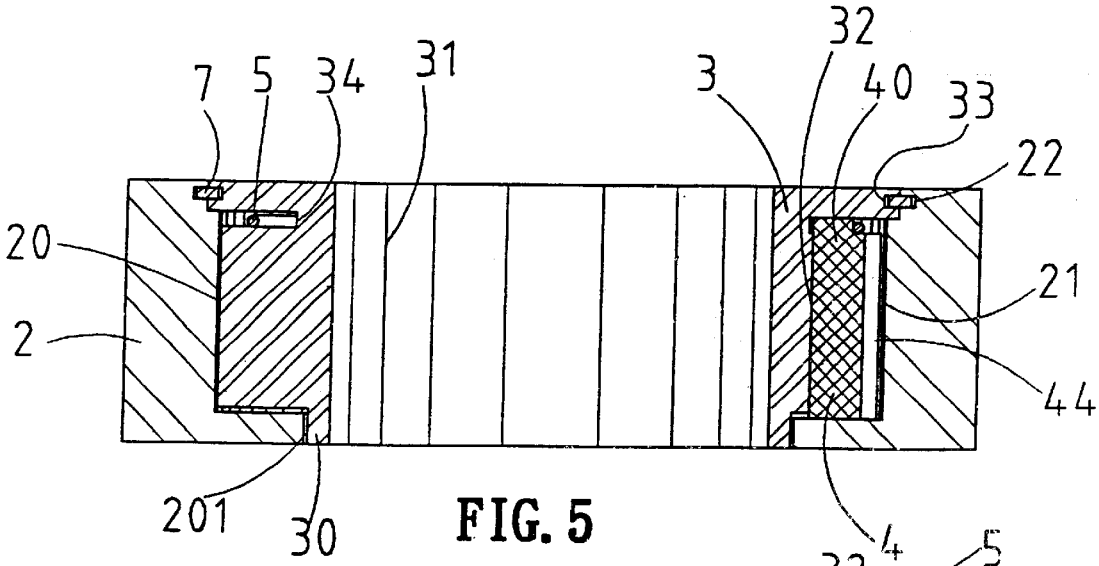
FIG. 5 shows a cross sectional view of the the ratchet tool of the present invention.

As shown in FIG. 3, when rotating the tool counter clockwise, the teeth 21 push the pawls 4 and let the short side 41 securely match with the short surface 320, and the driving member 3 is rotated with the tool because the pawls 4 push the driving member 3 to rotate. As shown in FIG. 4, when the tool is rotated in clockwise, the teeth 21 pushes the long side of each of the pawl 4 which is pivoted about axis of the rounded convex 42 and the teeth 21 move over the engaging teeth 44 of the pawls 4. The ratchet tool has no recesses to be drilled in the inside of the hole 20 so that no special tools and drills are required and the manufacturing cost can be reduced.

Figure 6:
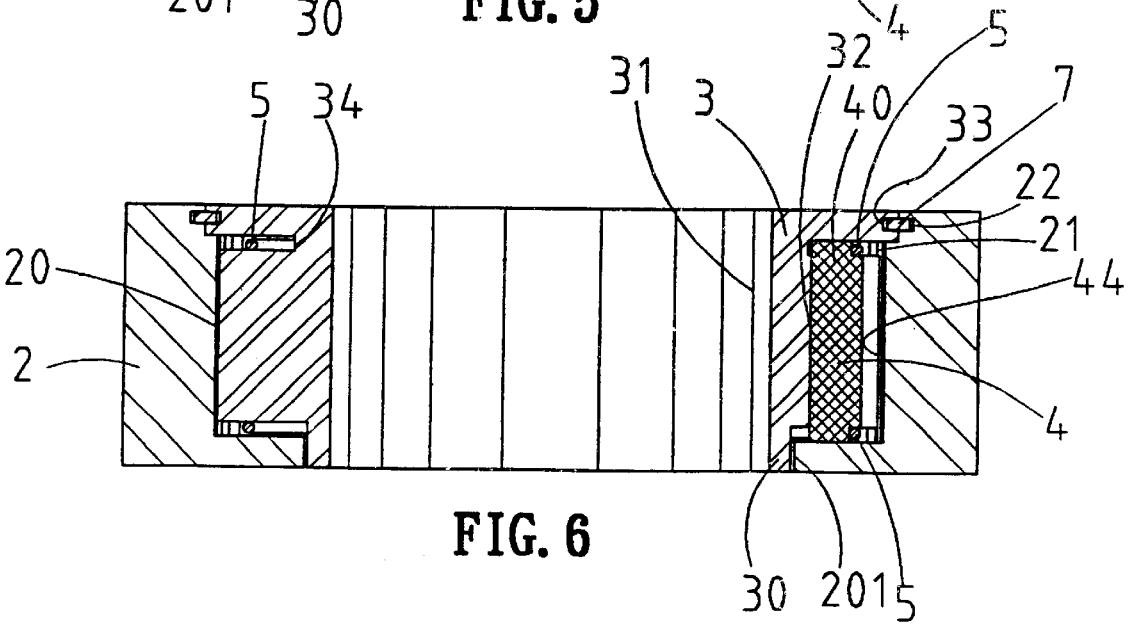
FIG. 6 is a cross sectional view to show another embodiment of the ratchet tool of the present invention.

FIG. 6 shows that the pawls 4 may have two protrusions 40 on the top and the bottom of each of the pawl 4 and two spring rings 5 are required to be mounted onto the protrusions 40.

While we have shown and described the embodiment in accordance with the present invention, it should be clear to those skilled in the art that further embodiments may be made without departing from the scope of the present invention.

What is claimed is:

1. A ratchet tool comprising:

a tool head having a hole defined therethrough and teeth defined in an inside of the hole, a driving member rotatably received in the hole and a plurality of notches defined in an outer periphery of the driving member and each notch comprising a short surface, a long surface and an arcuate surface which is connected between the short surface and the long surface;

each notch having a pawl received therein which is an elongate member having engaging teeth defined in a first end thereof and a rounded convex extending from a second end of the pawl, the engaging teeth engaged with the teeth in the inside of the hole, a short side and a long side respectively connected to two sides of the rounded convex, the rounded convex engaged with the arcuate surface of the notch corresponding thereto, the short side facing the short surface and the long side facing the long surface, a protrusion extending from one of a top and a bottom of each of the pawl, and a spring ring mounted to the protrusions of each of the pawls and pushing the pawls toward the driving member.

2. The ratchet tool as claimed in claim 1, wherein an annular groove is defined in the outer periphery of the driving member and communicates with the notches, the spring ring engaged with the annular groove.

3. The ratchet tool as claimed in claim 1, wherein a minimum distance between the rounded convex and the engaging teeth is longer than a minimum distance between the arcuate surface of each of the notches to the teeth defined in an inside of the hole.

4. The ratchet tool as claimed in claim 1, wherein the protrusion has an engaging surface defined in a vertical wall thereof and the engaging surface faces the teeth in the inside of the hole of the tool head, an extension line extending from the engaging surface intersecting the long side of the pawl at an acute angle.

* * * * *